US006978768B2

(12) United States Patent
Yamashita et al.

(10) Patent No.: US 6,978,768 B2
(45) Date of Patent: Dec. 27, 2005

(54) ACCELERATION CONTROL METHOD FOR ENGINE

(75) Inventors: Toshihiko Yamashita, Shizuoka-Ken (JP); Tomoji Nakamura, Shizuoka-Ken (JP)

(73) Assignee: Yamaha Hatsudoki Kabushiki Kaisha, Iwata (JP)

( * ) Notice: Subject to any disclaimer, the term of this patent is extended or adjusted under 35 U.S.C. 154(b) by 176 days.

(21) Appl. No.: 10/476,773

(22) PCT Filed: Oct. 8, 2002

(86) PCT No.: PCT/JP02/10431

§ 371 (c)(1),
(2), (4) Date: Apr. 19, 2004

(87) PCT Pub. No.: WO03/036066

PCT Pub. Date: May 1, 2003

(65) Prior Publication Data

US 2004/0168676 A1 Sep. 2, 2004

(30) Foreign Application Priority Data

Oct. 19, 2001 (JP) ..... 2001-321633

(51) Int. Cl.[7] ..... F02M 51/00
(52) U.S. Cl. ..... 123/491; 123/492; 701/110
(58) Field of Search ..... 123/491, 492; 701/110

(56) References Cited

U.S. PATENT DOCUMENTS 3,759,231 A * 9/1973 Endo ..... 123/492
6,379,284 B1 * 4/2002 Hanai et al. ..... 477/200

FOREIGN PATENT DOCUMENTS

| | | |
|---|---|---|
| JP | 48-053117 | 7/1973 |
| JP | 58-041229 | 3/1983 |
| JP | 63-189626 | 8/1988 |
| JP | 06-117315 | 4/1994 |
| JP | 2001-132506 | 5/2001 |

* cited by examiner

*Primary Examiner*—John T. Kwon
(74) *Attorney, Agent, or Firm*—Hogan & Hartson, LLP

(57) ABSTRACT

To provide an acceleration control method for an engine, which determines the accelerating state appropriately without a sensor, a mechanism, or the like specially added for determining the accelerating state and performs suitable acceleration control, while it prevents acceleration misdetermination at engine start or at an extremely low engine speed to improve engine startability and drivability at an extremely low engine speed.

An acceleration control method for a four-stroke engine, in which a pulse is generated for every predetermined crank angle for detecting a crank angle of the engine, a transient state of the engine is determined by detecting the pulse and by detecting the intake air pressure in the intake passage on a downstream side of a throttle valve of the engine, and the acceleration control is performed according to the state of the engine, is characterized in that the acceleration control is prohibited on condition that the engine state is at engine start or at an extremely low engine speed, and in that the acceleration control is allowed otherwise.

3 Claims, 7 Drawing Sheets

ACCELERATION CONTROL METHOD FOR ENGINE

FIELD OF THE INVENTION

This invention relates to an acceleration control method for an engine, and particularly to an acceleration control method during acceleration based on the intake pipe pressure.

PRIOR ART

In a motorcycle with a fuel injection engine mounted thereon, transient control is performed, such that acceleration control is performed by controlling fuel injection quantity, ignition timing, or air-fuel ratio according to the accelerating state for higher output, and a smooth shift from normal operation to accelerating operation is possible according to a quick throttle opening or the like.

In order to detect the accelerating state, the intake pipe pressure is measured for each cycle of a certain crank angle. When the measured value has been increased by predetermined pressure or higher compared with the intake pipe pressure at the same crank angle in the previous cycle, it is determined to be an accelerating state.

However, at incomplete engine start where the engine does not attain complete combustion after the first combustion, the engine speed increases momentarily and then decreases immediately. In this case, the intake pipe pressure decreases as the engine speed increase, and after that, the intake pipe pressure increases as the engine speed decreases. At incomplete engine start, where the intake pipe pressure increases while the engine speed decreases, a system which detects the accelerating state according to the intake pipe pressure determines that the engine is in an accelerating state, performs acceleration control such as asynchronous injection and advanced injection timing, and therefore deteriorates engine startability.

At an extremely low engine speed in the vicinity of the idling speed, the intake pipe pressure increases as the engine speed decreases. At an extremely low engine speed, a system which detects the accelerating state according to the intake pipe pressure determines that the engine is in an accelerating state because of the intake pipe pressure increase accompanied by the engine speed decrease, and performs acceleration control such as acceleration increase, and therefore obstructs suitable operation of the engine.

The present invention is made in view of the prior art described above, and the object is to provide an acceleration control method for an engine, which determines the accelerating state appropriately without a sensor, a mechanism, or the like specially added for determining the accelerating state, and performs suitable acceleration control, while it prevents acceleration misdetermination at engine start or at an extremely low engine speed to improve engine startability and drivability at an extremely low engine speed.

DISCLOSURE OF THE INVENTION

In order to achieve the above objects, this invention provides an acceleration control method for a four-stroke engine, in which a pulse is generated for every predetermined crank angle for detecting a crank angle of the engine, a transient state of the engine is determined by detecting the pulse and by detecting the intake air pressure in an intake passage on a downstream side of a throttle valve of the engine, and the acceleration control is performed according to the state of the engine, characterized in that the acceleration control is prohibited on condition that the engine state is at engine start or at an extremely low engine speed, and in that the acceleration control is allowed otherwise.

With this constitution, the engine state at engine start or at an extremely low engine speed is detected, and the control program is set such that the acceleration control is not performed under those states. Thus, at engine start and at an extremely low engine speed, asynchronous injection or advanced ignition due to acceleration misdetermination, air-fuel ratio enrichment due to acceleration increase, or the like is not performed, and therefore suitable acceleration control is achieved and engine startability and drivability at an extremely low engine speed are improved.

For further description, in an engine having an acceleration control program which produces injection timing, ignition timing, or air-fuel ratio suitable for the accelerating state during acceleration, for example, a pulse signal corresponding to the crank angle is detected, the engine running state is detected according to the signal, the intake air pressure of the engine is detected, and it is determined according to the pressure whether or not the engine is under a transient state. Determining from these engine states, on condition that the engine is under a state at engine start or under a state at an extremely low engine speed (under a state either at engine start or at an extremely low engine speed), the acceleration control is not performed by the acceleration control program. Otherwise (when the engine is under a state neither at engine start nor at an extremely low engine speed), the acceleration control can be performed. This prohibits acceleration control according to acceleration misdetermination (such as asynchronous injection, advanced ignition, or air-fuel ratio enrichment due to acceleration increase) at engine start or at an extremely low engine speed, and therefore suitable acceleration control is achieved and engine startability and drivability at an extreme low engine speed are improved.

This invention further provides an acceleration control method for a four-stroke engine, in which a pulse is generated for every predetermined crank angle for detecting a crank angle of the engine, a transient state and a stroke of the engine are determined by detecting the pulse and by detecting the intake air pressure in an intake passage on a downstream side of a throttle valve of the engine, and the acceleration control is performed according to the determination, characterized in that the acceleration control is prohibited on condition that it is within a predetermined period after the determination of the stroke is complete or that the engine speed is at a predetermined value or lower, and in that the acceleration control is allowed otherwise.

With this constitution, in an engine having an acceleration control program which produces injection timing, ignition timing, or air-fuel ratio suitable for the accelerating state during acceleration, for example, a pulse signal corresponding to the crank angle is detected, the engine running state is detected according to the signal, the intake air pressure of the engine is detected, and it is determined according to the pressure whether or not the engine is under a transient state and which stroke the engine is in. On condition that a predetermined period has not been elapsed after determining the stroke or that the engine speed is at a predetermined value or lower (either a predetermined period has been elapsed after determining the stroke or the engine speed is at a predetermined value or lower), the acceleration control is not performed by the acceleration control program. Otherwise (both a predetermined period or more has been elapsed after determining the stroke and the engine speed is at a predetermined value or lower), the acceleration control can be performed. This prohibits acceleration control according to acceleration misdetermination (such as asynchronous injection, advanced ignition, or air-fuel ratio enrichment due to acceleration increase) at engine start or at an extremely low engine speed, and therefore achieving suitable acceleration control is achieved and engine startability and drivability at an extreme low engine speed are improved.

This invention further provides an acceleration control method for a four-stroke engine, having a step of detecting a pulse signal input for detecting a crank angle of the engine, a step of detecting the intake air pressure in an intake passage of the engine to save the data, and a step of determining whether or not the engine is at starting, characterized in that the acceleration control is prohibited on condition that the engine state is at engine start or that the engine speed is at a predetermined value or lower, and in that otherwise it is determined according to the intake air pressure data whether or not the engine is under the accelerating state, and, when it is under the accelerating state, the acceleration control is performed by means of at least one of fuel injection control, ignition timing control, and air-fuel ratio control.

With this constitution, in an engine having an acceleration control program which performs acceleration control by means of at least one of injection timing control, ignition timing control, or air-fuel ratio control suitable for the accelerating state during acceleration, a pulse signal corresponding to the crank angle is detected, the engine speed is detected according to the signal, and the intake air pressure of the engine is detected to save the data. On condition that the engine is under a state at engine start or under a state at an extremely low engine speed (under a state either at engine start or at an extremely low engine speed), the acceleration control is not performed by the acceleration control program. Only otherwise (when the engine is under a state neither at engine start nor at an extremely low engine speed), it is determined from the saved intake pipe pressure data whether or not the engine is under the accelerating state, and the acceleration control is performed. This prohibits acceleration control according to acceleration misdetermination at engine start or at an extremely low engine speed, and therefore suitable acceleration control is achieved and engine startability and drivability at an extreme low engine speed are improved.

An acceleration control method of the present invention is preferably embodied using a control unit for a four-stroke engine.

The use of the control unit for a four-stroke engine of the present invention, as described above, prohibits acceleration control according to acceleration misdetermination at engine start or at an extremely low engine speed, and therefore suitable acceleration control is achieved and engine startability and drivability at an extreme low engine speed are improved.

BEST FORM OF EMBODYING THE INVENTION

An embodiment of the present invention will be described below with reference to the accompanying drawings.

Figure 1:
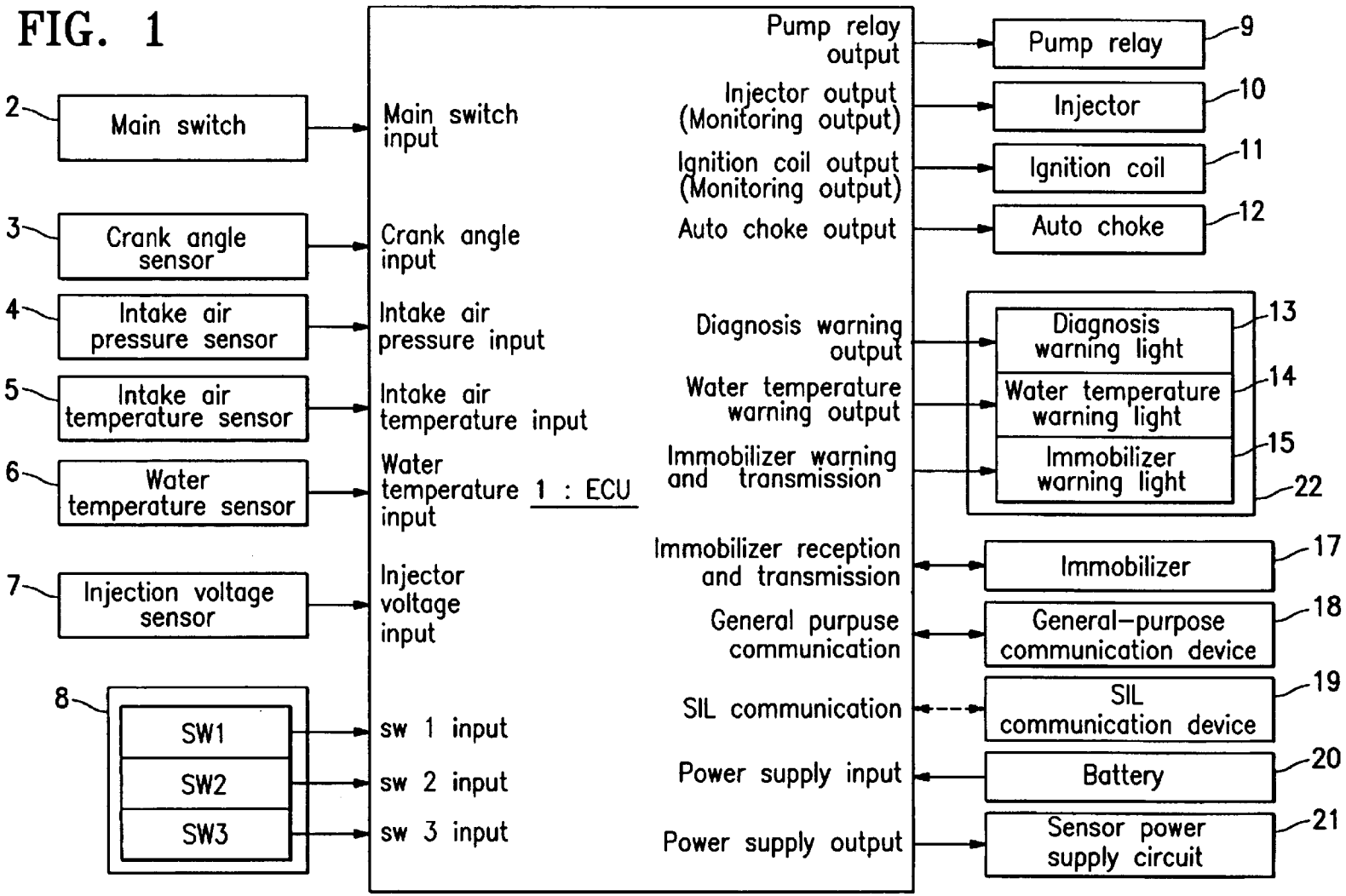
FIG. 1 is a block diagram of an entire control system of a motorcycle according to the present invention.

FIG. 1 is a general block diagram of a control system of a motorcycle according to the embodiment of the present invention.

An engine control unit (ECU) 1 is unitized to be an integral component. A control circuit CPU (not shown) of the ECU 1 receives inputs including an on/off signal from a main switch 2, a crank pulse signal from a crank pulse sensor 3, an intake air pressure detection signal from an intake air pressure sensor 4, an intake air temperature detection signal from an intake air temperature sensor 5, a cooling water temperature detection signal from a water temperature sensor 6, a voltage signal from an injector voltage sensor 7 for controlling an injector, and a checking input signal from a switch box 8 having a plurality of switches SW1 to SW3. The ECU 1 is also connected to a battery 20, from which battery power supply is inputted.

For outputs from the ECU 1, the ECU 1 outputs a pump relay output signal to a pump relay 9 for driving a fuel pump, an injector output signal for driving an electromagnetic coil of an injector 10, an ignition coil output signal for driving an ignition coil 11, an automatic choke output signal for driving an automatic choke 12 in response to cooling water temperature, a diagnosis warning signal for driving a diagnosis warning lamp 13 in a meter 22 when abnormality is detected, a water temperature warning signal for driving a water temperature warning lamp 14 to indicate a warning when the cooling water temperature exceeds a predetermined temperature, and an immobilizer warning signal for driving an immobilizer warning lamp 15 when an immobilizer 17 of an engine key or the like is abnormally operated. Power supply voltage is outputted for supplying power to each sensor either through a sensor power supply circuit 21 or directly.

The ECU 1 is also connected to an external general purpose communication device 18 and capable of inputting/outputting control data or the like through a general purpose communication line. The ECU 1 is further connected to a serial communication device 19 and capable of handling serial communication.

Figure 2:
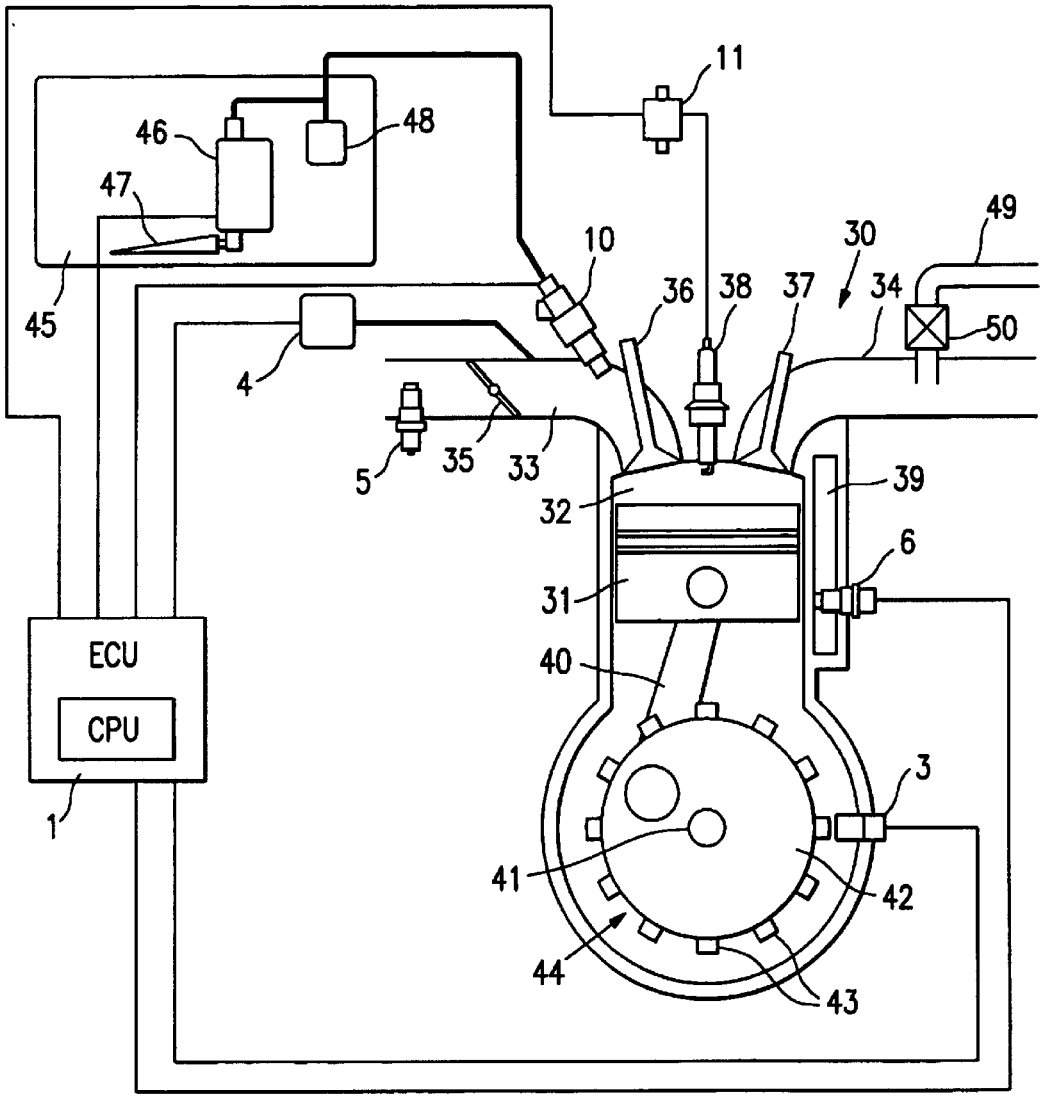
FIG. 2 is a schematic diagram of a crank angle detection apparatus for an engine according to the present invention.

FIG. 2 is a system structure diagram of a crank angle detection device according to the embodiment of the present invention.

A single-cylinder four-stroke engine 30 is formed with a combustion chamber 32 on top of a piston 31. An intake pipe 33 and an exhaust pipe 34 are connected to the combustion chamber 32 so as to communicate with the combustion chamber 32. A throttle valve 35 is provided in the intake pipe 33, and an intake valve 36 is disposed at an end thereof. An exhaust valve 37 is provided at an end of the exhaust pipe 34. The reference numeral 38 denotes an ignition plug. Around a cylinder of the engine 30 is provided a cooling jacket 39, to which the water temperature sensor 6 is attached. The piston 31 is connected to a crankshaft 41 through a connecting rod 40.

A ring gear 42 is integrally secured to the crankshaft 41. The ring gear 42 has plural teeth (projections) 43 formed at equal intervals, among which one toothless portion 44 is provided. The crank angle sensor (crank pulse sensor) 3 is provided for detecting the teeth 43 formed on the ring gear 42. The crank angle sensor 3 detects each tooth 43 to generate a pulse signal having a pulse width that corresponds to a lateral length on the upper side of the tooth. In this example, 12 portions to be each provided with the tooth 43 include one toothless portion 44 so that the sensor generates 11 pulse signals one per 30° of one crank rotation.

The injector 10 is attached to the intake pipe 33. Fuel pumped from a fuel tank 45 through a filter 47 using a fuel pump 46 is delivered to the injector 10 under a constant fuel pressure maintained by a regulator 48. The ignition coil 11 controlled by the ECU 1 (FIG. 1) is connected to the ignition plug 38. The intake air pressure sensor 4 and the intake air temperature sensor 5 are attached to the intake pipe 33, which are separately connected to the ECU 1.

A secondary air introducing pipe 49 for cleaning exhaust gas is connected to the exhaust pipe 34. An air cut valve 50 is provided on the secondary air introducing pipe 49. The air cut valve 50 opens at high engine speed with the throttle opened during normal driving or acceleration to introduce secondary air, while closing at low engine speed with the throttle closed during deceleration to cut off the secondary air.

Figure 3:
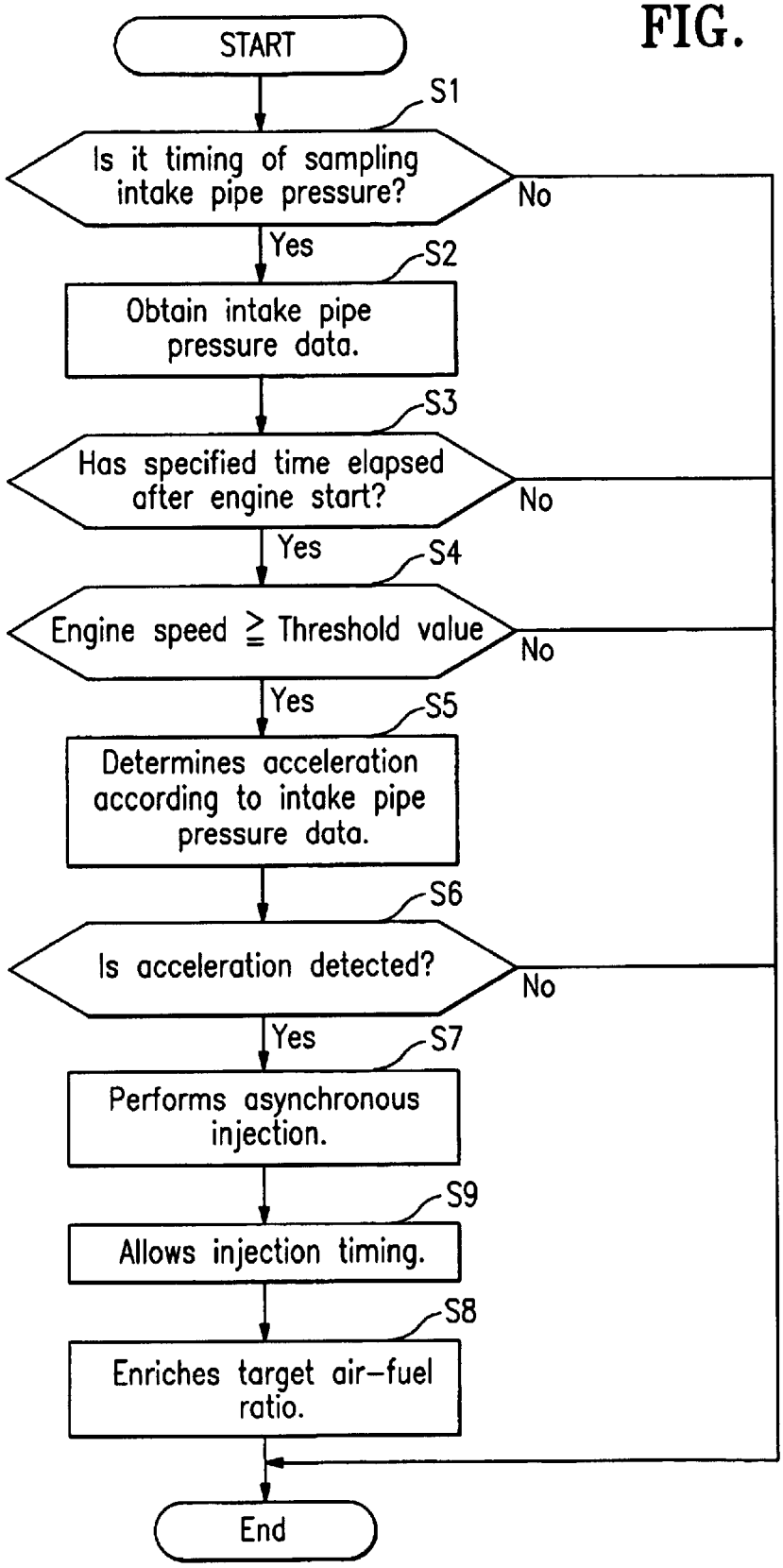
FIG. 3 is a flowchart of the acceleration control according to the present invention.

FIG. 3 is a flowchart of acceleration control according to the present invention.

Step S1: Determines whether it is a timing of sampling the intake pipe pressure or not. Since the crank angle is predetermined at which the rise in the intake pipe pressure due to acceleration can be properly detected, it is determined whether or not the timing at the predetermined crank angle is met. The crank angle is detected in such a way that each of the teeth of the ring gear attached to the crankshaft is detected by the crank angle sensor, the generated crank pulse signal is input to the CPU in the ECU, and then the crank angle is determined from the signal data. The CPU is configured to run an interrupt program every time the crank angle signal is input, and determines whether it is the timing of sampling the intake pipe pressure or not.

Step S2: Converts the detected data from the intake air pressure sensor from analog to digital, reads and saves it when it is determined that the timing of sampling the intake pipe pressure is met.

Step S3: Determines whether or not a specified time has elapsed after the engine start. The elapsed time is measured here since the crankshaft rotation was started and the first crank pulse signal was generated. If the predetermined time has not yet elapsed, a determination is made that the engine has just been started. No acceleration control is performed during the engine start because warm-up control is performed. If engine conditions have changed from warm-up to normal operation after the engine start and the elapse of the predetermined time (or if a certain time has elapsed since immediately after the engine start and the engine has shifted to a stable state even during warm-up), the process proceeds to the next step S4.

Step S4: Determines whether or not engine speed is at a predetermined threshold value or higher when it is determined as not in a startup time. This threshold value should be a value of engine speed according to the engine performance, known from an experiment in advance or the like, and covering a range of engine speed where the intake pipe pressure rises as the engine speed decreases at a low speed. When the speed is extremely low below the threshold value, acceleration is not performed. Only when it is at the predetermined speed or higher, the step proceeds to the next step S5.

Step S5: Determines a state of acceleration according to the intake pipe pressure data stored in the step S2 above. That is, intake pipe pressure data stored in an ongoing interrupt routine is compared with the intake pipe pressure data at the same crank angle of the previous cycle stored in the previous interrupt routine.

Step S6: Determines whether or not the engine is under a state of acceleration depending on the determination whether the intake pipe pressure data detected this time is larger than the intake pipe pressure data detected the previous time by a predetermined value or larger. If the intake pipe pressure is higher by the predetermined value or larger, it is determined that the engine is under the state of acceleration, and acceleration control is performed in the following steps S7 to S9.

Step S7: Performs asynchronous injection control for an optimum injection amount and timing for acceleration, by drive control of the electromagnetic coil of the injector.

Step S8: Controls ignition timing for obtaining the output corresponding to the state of acceleration by advancing the ignition timing by controlling the ignition coil.

Step S9: Controls air-fuel ratio for obtaining the output corresponding to the state of acceleration by enriching a target air-fuel ratio of a control program.

FIG. 4 is another flowchart of the acceleration control method according to this invention. In the acceleration control program according to this embodiment, after the engine speed is determined at the step S4 in FIG. 3, a determination step is provided where the acceleration control is prohibited or allowed.

Figure 4A:
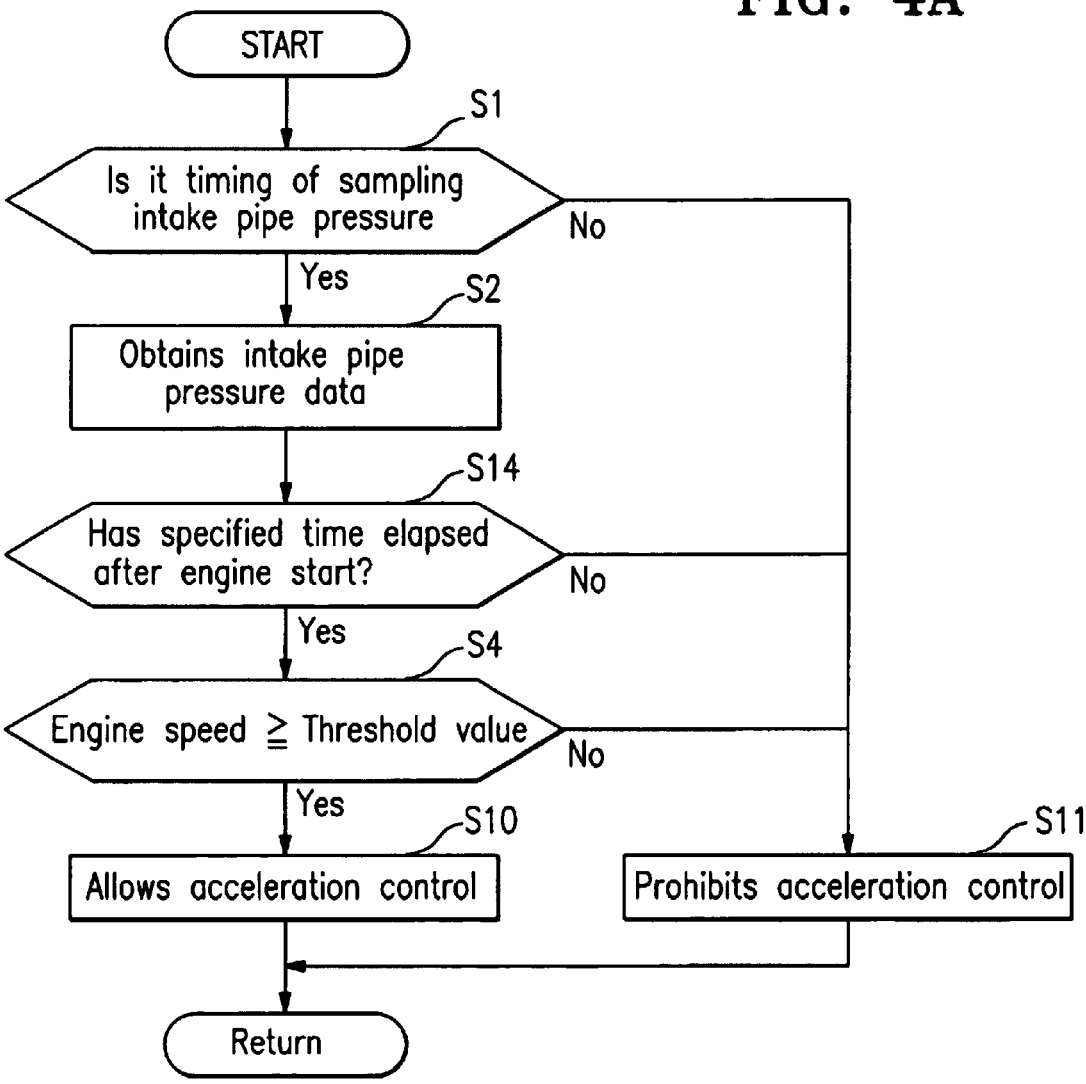
FIG. 4 is a flowchart of another example of the acceleration control according to the present invention.

Steps S1 to S4 in FIG. 4(A) are the same as the steps S1 to S4 in FIG. 3 described above. In the example in FIG. 4(A), the step S4 is followed by steps S10 and S11 described below.

Step S10: When "Yes" is determined (the engine speed is the threshold value or higher) at the step S4, it is determined that the engine is under a state where the acceleration control can be performed, and a flag for allowing the acceleration control is set. That is, when "Yes" is determined at all the determining steps of S1, S3, and S4, the flag for allowing the acceleration control is set so as to perform the acceleration control under the accelerating state.

Step S11: When "No" is determined (the engine speed is below the threshold value) at the step S4, it is determined that the engine is under a state where the acceleration control should not be operated, and a flag for prohibiting the acceleration control is set. That is, when "No" is determined at any one of the steps S1, S3, and S4, it is determined that the engine is under the state where the acceleration control should not be operated, and a flag for prohibiting the acceleration control is set.

Figure 4B:
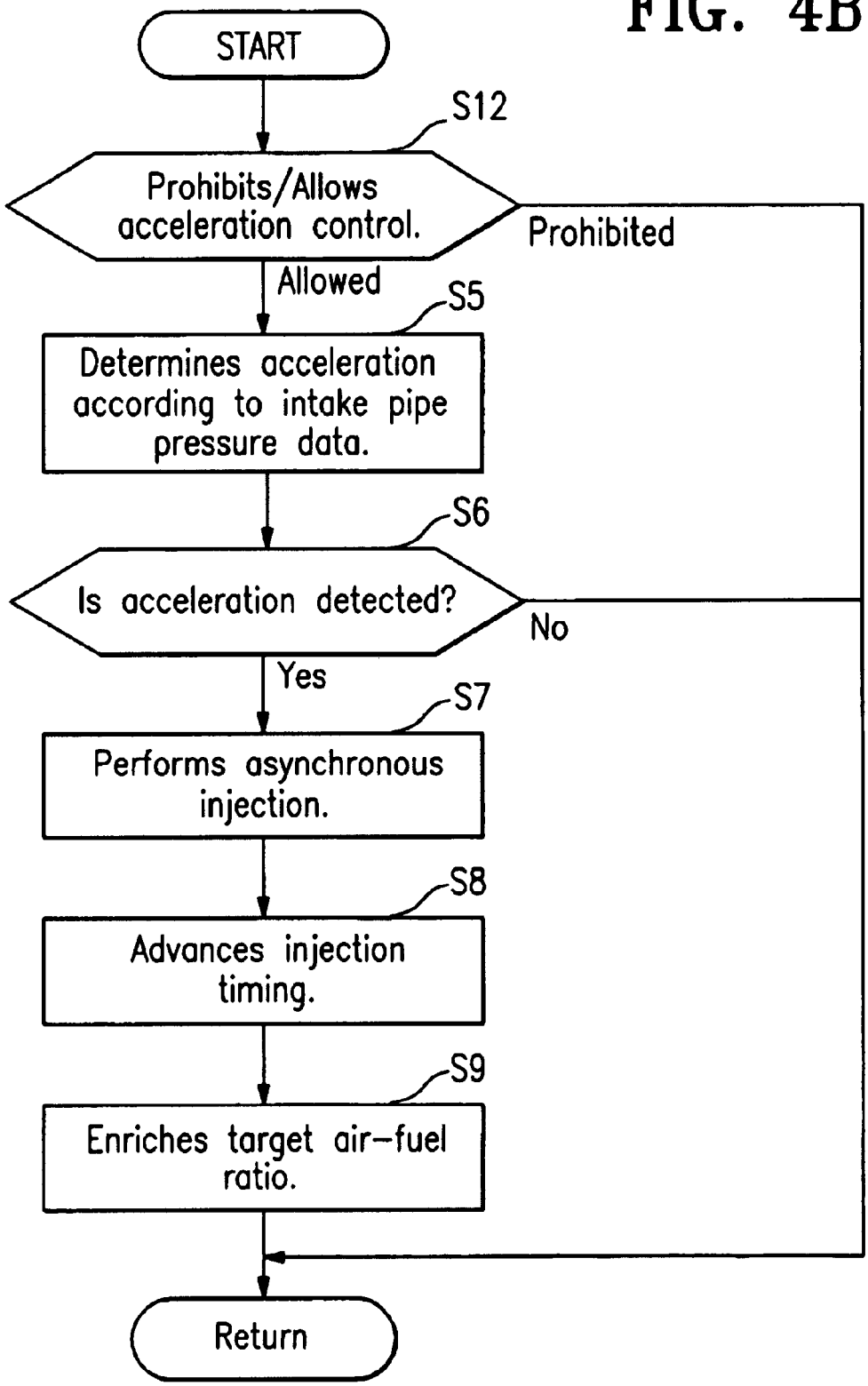

FIG. 4(B) is a flowchart according to the determination of either allowing or prohibiting the acceleration control made in FIG. 4(A). In the flowchart in FIG. 4(B), steps S5 to S9 are the same as the steps S5 to S9 in FIG. 3 described above. In the example in FIG. 4(B), the step 5 is preceded by a step S12 described below.

Step S12: It is determined whether the engine is under the state allowing the acceleration control or under the state prohibiting the acceleration control according to the flag for allowing or the acceleration control or the flag for prohibiting the acceleration control set in the step S10 or S11, respectively, in FIG. 4(A) described above. If it is under the state for allowing the acceleration, the acceleration control is performed according to the steps S5 to S9. If it is under the state for prohibiting the acceleration, no acceleration control is performed and the procedure exits from the flow.

The acceleration control method shown in the flowcharts in FIGS. 3 and 4 is implemented using the ECU in FIGS. 1 and 2 described above.

Figure 5A:
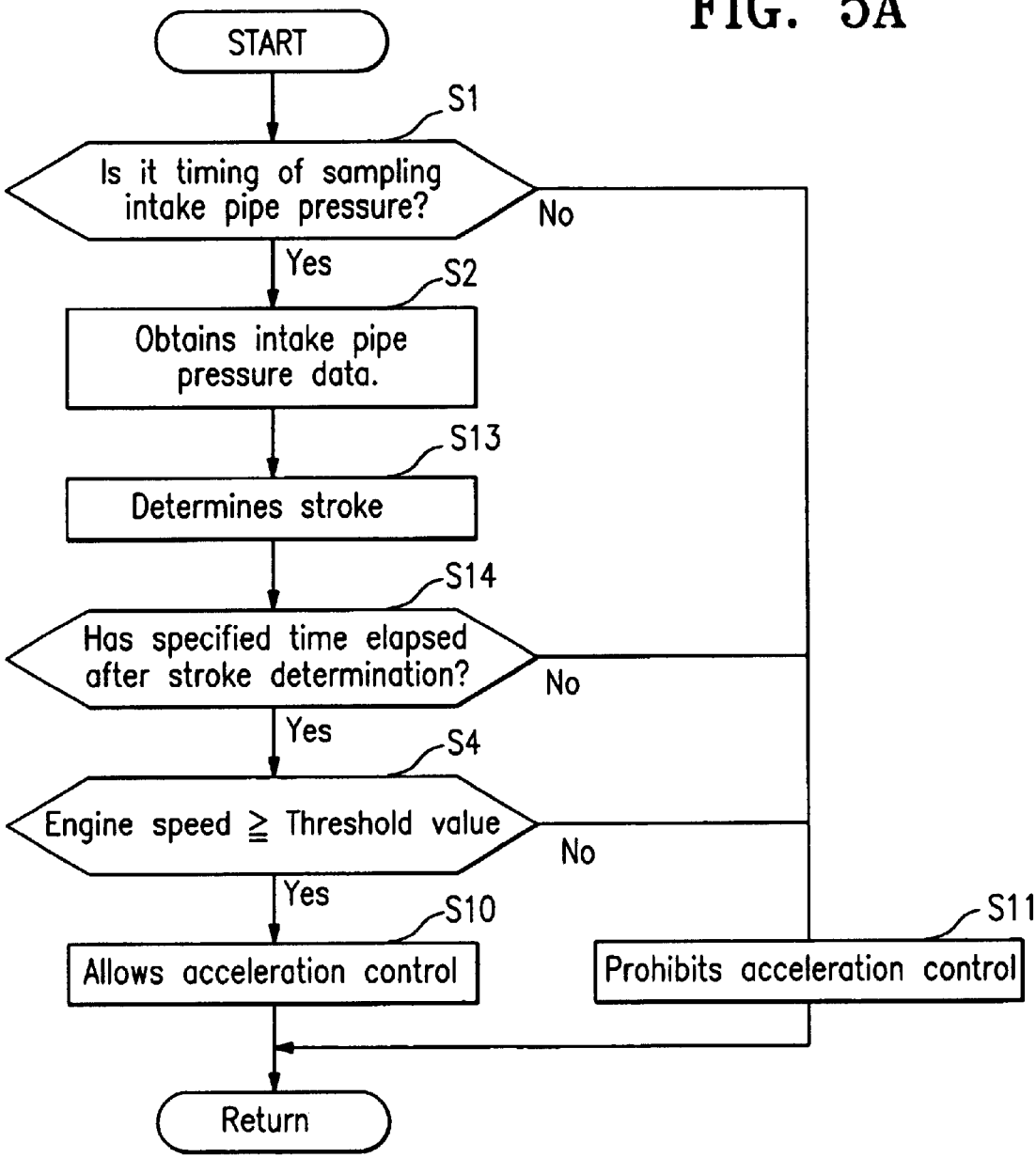
FIG. 5 is a flowchart of still another example of the acceleration control according to the present invention.
Figure 5B:
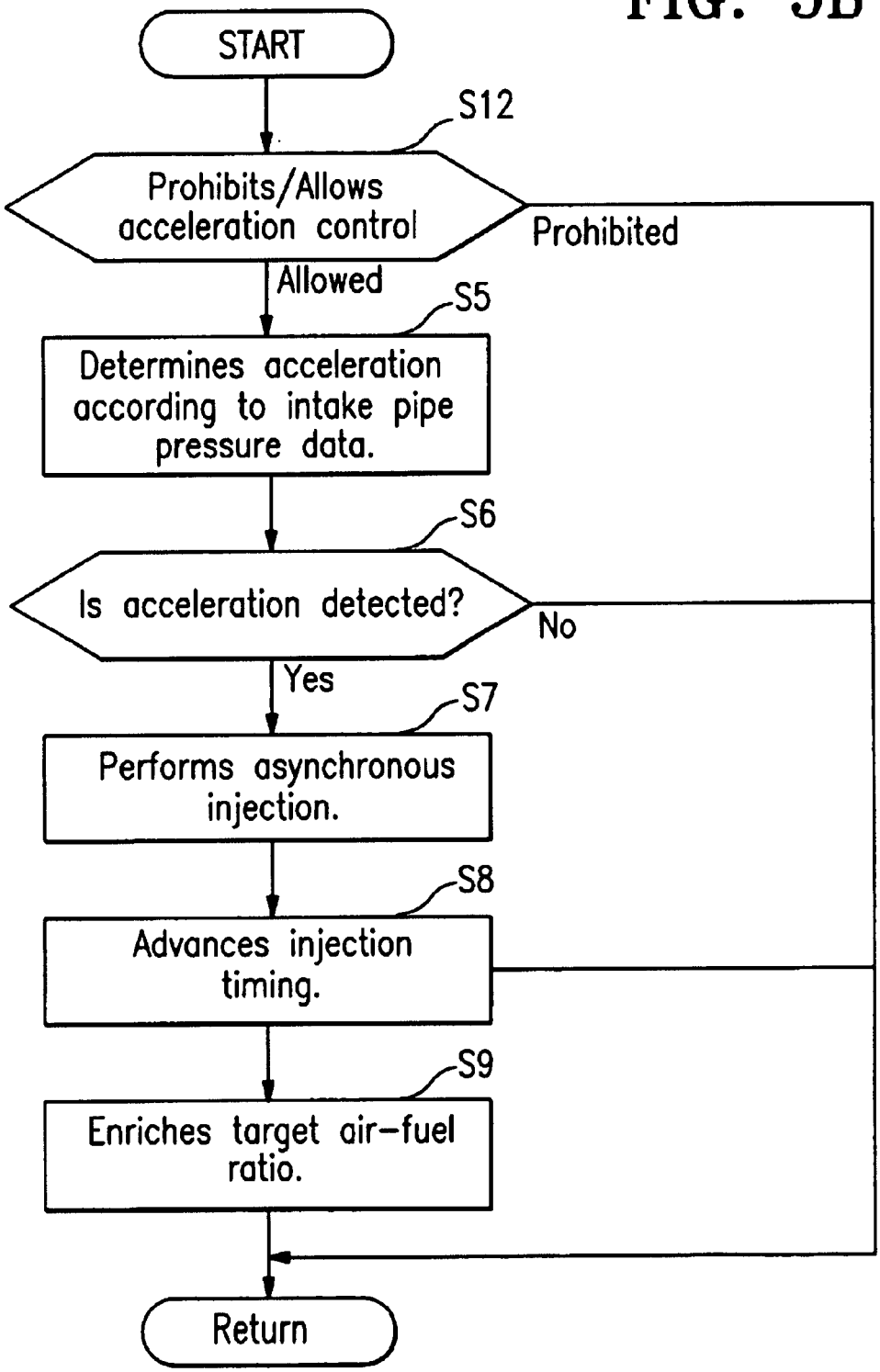

FIG. 5 is a flowchart of still another example of the acceleration control method according to this invention. In this example, the step S3 in the example in FIG. 4 is substituted by steps S13 and S14 described below.

Step S13: Four strokes (intake→compression→expansion→exhaust) constituting one cycle, or two rotations, in 4-stroke engines are determined according to the crank pulse signal and the intake air pressure data, or solely according to the crank pulse signal.

The stroke determining step is performed as described below, for example.

One rotation of the crankshaft is divided into 13 stages including a toothless portion. One cycle of the strokes is composed of two rotations (26 stages) of the crankshaft, to which stage numbers #0 to #26 are assigned, respectively.

Here, stages of the same phase with respect to the crankshaft, for example, the stages #5 and #10 and the stages #18 (corresponding to #5) and #23 (corresponding to #10) are compared in terms of the rotation cycle. The rotation cycle at the stage #10 is then longer than that at the stage #5, which is maintained irrespective of the intake pipe pressure. Comparing the stages #18 and #23, as opposed to the above, the rotation cycle at the stage 18 is longer than that at the stage 23, which is also maintained irrespective of the intake pipe pressure.

Thus, even when the phase of the crankshaft is the same, correspondence between the stages and the strokes can be determined, irrespective of the intake pipe pressure, by examining the rotation cycle.

The stroke determining step S13 described above and a time lapse determining step S14 may be arranged in any position before the acceleration control allowing step S10 in FIG. 5(A). They may be arranged together with the step S3 for determining whether the predetermined period of time has passed after the engine start.

The stroke determining step S13 may be performed in another routine, from which only the lapse time data is read into the present routine.

INDUSTRIAL USABILITY

As described above, in the present invention, the engine state at engine start or at an extremely low engine speed is detected, and the control program is set such that the acceleration control is not performed under those states. Thus, at engine start and at an extremely low engine speed, asynchronous injection or advanced ignition due to acceleration misdetermination, air-fuel ratio enrichment due to acceleration increase, or the like is not performed, and therefore suitable acceleration control is achieved and engine startability and drivability at an extremely low engine speed are improved.

What is claimed is:

1. An acceleration control method for a four-stroke engine, comprising:

generating a pulse for every determined crank angle for detecting a crank angle of the engine, determining a transient state of said engine by detecting the pulse and by detecting the intake air pressure in an intake passage on a downstream side of a throttle valve of said engine, and performing acceleration control according to the state of the engine, characterized in that the acceleration control is prohibited on condition that said engine state is at engine start or at an extremely low engine speed, and in that the acceleration control is allowed otherwise.

2. An acceleration control method for a four-stroke engine, comprising:

generating a pulse for every determined crank angle for detecting a crank angle of the engine, determining a transient state and a stroke of said engine by detecting the pulse and by detecting the intake air pressure in an intake passage on a downstream side of a throttle valve of said engine, and performing acceleration control according to the determination, characterized in that the acceleration control is prohibited on condition that a predetermined period is elapsed after the determination of said stroke is complete or that said engine speed is at a predetermined value or lower, and in that the acceleration control is allowed otherwise.

3. An acceleration control method for a four-stroke engine, having a step of detecting a pulse signal input for detecting a crank angle of the engine, a step of detecting the intake air pressure in an intake passage of said engine to save the data, and a step of determining whether or not the engine is at engine start, characterized in that the acceleration control is prohibited on condition that said engine state is at engine start or that said engine speed is at a predetermined value or lower, and in that otherwise it is determined according to said intake air pressure data whether or not the engine is under the accelerating state, and, when it is under the accelerating state, the acceleration control is performed by means of at least one of fuel injection control, ignition timing control, and air-fuel ratio control.

* * * * *